US005496032A

United States Patent [19]

Okada

[11] Patent Number: 5,496,032

[45] Date of Patent: Mar. 5, 1996

[54] MANAGEMENT METHOD FOR GAMING HALL

[75] Inventor: Kazuo Okada, Tokyo, Japan

[73] Assignee: Universal Sales Co., Ltd., Tokyo, Japan

[21] Appl. No.: 191,294

[22] Filed: Feb. 3, 1994

[30] Foreign Application Priority Data

Feb. 3, 1993 [JP] Japan ..... 5-016351

[51] Int. Cl.[6] ..... A63F 9/00

[52] U.S. Cl. ..... 273/138 A; 273/121 B

[58] Field of Search ..... 273/138 A, 138 R, 273/148 R, 143 R, 85 CP, 121 B; 364/410–412

[56] References Cited

U.S. PATENT DOCUMENTS

| | | | |
|---|---|---|---|
| 4,072,930 | 2/1978 | Lucero et al. | 273/138 A X |
| 4,283,709 | 8/1981 | Lucero et al. | 273/138 A |
| 4,531,187 | 7/1985 | Uhland | 364/412 |
| 4,611,808 | 9/1986 | Palmer | 273/138 A |
| 4,669,731 | 6/1987 | Clarke | 273/143 R |
| 4,679,143 | 7/1987 | Hagiwara | 364/412 |
| 4,775,937 | 10/1988 | Bell | 364/412 |
| 5,257,179 | 10/1993 | DeMar | 364/410 |
| 5,332,076 | 7/1994 | Ziegert | 273/138 A |

FOREIGN PATENT DOCUMENTS

| | | | |
|---|---|---|---|
| 4135447 | 4/1993 | Germany | 273/138 A |

*Primary Examiner*—Jessica J. Harrison
*Attorney, Agent, or Firm*—Young & Thompson

[57] ABSTRACT

A management method detects fraudulent acts in a gaming hall containing a number of slot machines. Data representing the number of inserted tokens and the number of paid-out dividend tokens, into and from each slot machine, are supplied to a computer. By using the supplied data, a payout factor for each slot machine is calculated and an alarm signal specific to the degree of the payout factor is emitted. An expected sales amount for each individual slot machine is calculated from the numbers of inserted and paid-out tokens. An actual individual sales amount is calculated in accordance with data representing the number of tokens dispensed from a token dispenser paired with each slot machine. The difference between the expected sales amount and the actual sales amount is calculated, and an alarm signal specific to the degree of the difference is emitted, e.g. in the form of a visible display.

35 Claims, 6 Drawing Sheets

FIG. 3

29

DIFFERENCE ALARM A,C CLOSED 1992/10/10 19:23(1)

| MACHINE CODE | MACHINE NAME |
|---|---|
| 21 | CONTINENTAL |

40

OPERATION A

| MACHINE NO. | 1 | 2 | 3 | 4 | 5 | 6 | 7 | 8 | 9 | 10 | 11 | 12 |
|---|---|---|---|---|---|---|---|---|---|---|---|---|
| EXPECTED SALES | 37000 | ... | ... | ... | ... | ... | ... | ... | ... | ... | ... | ... |
| ACTUAL SALES | 20000 | ... | ... | ... | ... | ... | ... | ... | ... | ... | ... | ... |
| DIFFERENCE | 17000 | ... | ... | ... | ... | ... | ... | ... | ... | ... | ... | ... |

OPERATION C

| MACHINE NO. | 1 | 2 | 3 | 4 | 5 | 6 | 7 | 8 | 9 | 10 | 11 | 12 |
|---|---|---|---|---|---|---|---|---|---|---|---|---|
| NO. OF C OPERATIONS | 2 | 0 | 1 | ... | ... | ... | ... | ... | ... | ... | ... | ... |

FIG. 4

29

DIFFERENCE ALARM (TOTAL) CLOSED 1992/10/10 19:23

EXCHANGE INFORMATION

| | EXPECTED VALUE | ACTUAL VALUE | DIFFERENCE |
|---|---|---|---|
| NO. OF EXCHANGES | | | |
| NO. OF EXCHANGED TOKENS | | | |
| AVERAGE OF EXCHANGED TOKENS | | | |

DISPLAY OF WORST 10 OF OPERATIONS A & C

| | OPERATION A | | | | OPERATION C | |
|---|---|---|---|---|---|---|
| ORDER | MACHINE NO. | EXPECTED SALES | ACTUAL SALES | DIFFERENCE | MACHINE NO. | NO. OF RED ALARMS |
| 1 | | | | | | |
| 2 | | | | | | |
| ... | ... | ... | ... | ... | ... | ... |
| 9 | | | | | | |
| 10 | | | | | | |

MANAGEMENT METHOD FOR GAMING HALL

BACKGROUND OF THE INVENTION

1. Field of the Invention

The present invention relates to a management method for a gaming hall containing a great number of gaming machines. More particularly, the invention relates to a management method for monitoring whether gaming machines are properly operated and for emitting an alarm signal if they are not.

2. Description of the Related Art

A gaming hall such as a casino or the like contains a great number of gaming machines such as slot machines and Japanese pin ball machines (pachinko machines). A slot machine uses tokens (including coins) as its playing media and a pachinko machine uses steel balls as its playing media.

Many gaming halls use a management system for checking whether gaming machines are properly operated without fraud or irregularity by players and employees. For example, each pachinko machine is equipped with a magnetic sensor and an opening sensor for a transparent front door, and these sensors are connected to a computer of the management system. This management computer has a management program to detect fraudulent acts and give an alarm. Fraudulent acts include changing the path of fall of a steel ball by using a magnet so as to draw the ball into a winning hole, or opening the transparent front door and manually entering a steel ball into a winning hole. A TV camera is also located in some gaming halls to monitor fraudulent acts by players.

It is also known to display the ratio (payout factor) of the number of playing media entered into a gaming machine to the number of paid-out media, on a display screen of the management computer. In this case, a payout factor is preset for each gaming machine.

Another unacceptable act is to use playing media of a different gaming hall. For such a player, the sales of the subject hall are zero. If this player using media of the different gaming hall wins media of the subject hall and exchanges them for premiums (such as goods and money), the subject hall has a deficit and must regard this as fraud. Conventional management systems have been unable to detect such a fraudulent act.

In other possible cases, an employee steals playing media from a gaming machine and passes them to a confederate player, or an employee increases the count of a credit counter for a confederate player.

These fraudulent acts can be detected only after closing the gaming hall, by checking the total number of sold playing media representing the sales of the hall, the total number of media exchanged for premiums, the total number of media inserted in all the gaming machines, and the total number of media paid out from all the gaming machines. However, the time and location of each fraudulent act cannot be identified by a conventional management system. In addition, it is necessary for a conventional management system to mount a sensor or the like on each gaming machine, resulting in a complicated machine structure and high cost. A TV monitor system requires a person in charge who monitors display screens, increasing the number and cost of personnel.

There is also the problem of over-pay, which leads to a large deficit for a gaming hall. The term "over-pay" as used herein means a payout factor much larger than the payout factor preset for each slot machine or pachinko machine, because of an abnormal operation of a microcomputer provided for each machine or of a fraudulent act by a player.

OBJECTS OF THE INVENTION

It is a principal object of the present invention to provide a management method capable of detecting an unacceptable use of playing media from a different gaming hall, a theft of playing media from a gaming machine, or a fraudulent increase in the count of a credit counter of a gaming machine.

It is another object of the present invention to provide a management method capable of identifying the gaming machine at which a fraudulent act has taken place.

It is a further object of the present invention to provide a management method capable of easily detecting and correcting over-pay from any gaming machine.

SUMMARY OF THE INVENTION

The above and other objects of the present invention can be achieved by calculating the difference between expected sales data (money amount or number of playing media) and actual sales data (money amount or number of playing media) for each gaming machine, and by displaying an alarm signal specific to the degree of the difference. This management method is applied to each gaming machine so that a fraudulent act at any gaming machine can be found indirectly from the alarm signal. The expected sales data are calculated for each gaming machine from the total number of playing media inserted into the machine for games and the total number of playing media paid out as dividends for wins. The number of playing media can be converted to the money amount by referring to the value of the playing medium (exchange rate). The actual sales data are obtained from sales data (sales money amount or number of dispensed playing media) of a playing media dispenser paired with each gaming machine. Calculating the difference and displaying an alarm signal are performed at a predetermined time interval or during a temporary interruption of play.

According to a preferred embodiment of the present invention, expected total sales data and total actual sales data are obtained each time a predetermined time has elapsed, and an alarm signal is emitted which is specific to the degree of the difference between the data. The expected total sales data are the sum of the expected sales amounts of the respective gaming machines. The actual total sales data are a sum of the actual sales amounts of the respective playing media dispensers. As a result, it is possible to check whether the total sales amount of a gaming hall is proper or not, and to provide easy management of the hall.

According to another preferred embodiment of the present invention, the actual total number of tokens exchanged for premiums and the expected total number of playing media expected to have been exchanged for premiums are obtained each time a predetermined time has elapsed, and an alarm signal is emitted which is specific to the degree of the difference between the numbers. A playing media counter counts the number of playing media when it exchanges playing media for premiums (something of value such as goods or money). The actual total number of playing media exchanged for premiums is the sum of the numbers of playing media counted by the respective playing media counters. The expected total number of playing media is the sum of the playing media expected to have been exchanged for premiums plus the playing media still held by players. As a result, it is possible to determine whether the conditions of exchanging playing media for premiums in the gaming hall are proper or not, and thus to provide for easier management of the hall.

According to a further preferred embodiment of the present invention, the expected total quotient and the actual total quotient are obtained each time a predetermined period of time has elapsed, and an alarm signal is emitted which is specific to the degree of the difference between the two quotients. The expected total quotient for the entire number of gaming machines is calculated from the expected total number of playing media to be exchanged for premiums, the expected total number of playing media to be still held by all players, and the expected total sales amount. The actual total quotient of the gaming hall is calculated from the actual total sales amount, the actual total number of playing media inserted into all gaming machines, and the actual total number of dividend playing media paid out from all gaming machines. As a result, it is possible to determine whether the quotient for the gaming hall is proper or not, and thus to provide easier management of the hall.

According to another preferred embodiment of the present invention, the ratio between the number of playing media inserted into all the gaming machines and the number of dividend playing media paid out from all the gaming machines is frequently calculated, and an alarm signal is emitted which is specific to the size of the ratio. As a result, it is possible to determine the actual payout factor of each gaming machine and to detect any over-pay condition indicating an extremely high payout factor of playing media.

According to the present invention, differences between the expected and actual values for the sales amount, the number of playing media exchanged for premiums, and the quotient, are calculated for each gaming machine and for all the machines, in accordance with data obtained from gaming machines, playing media dispensers, playing media counters, and the like. The presence or absence of a fraudulent act is judged from the degree of each difference between expected and actual values, and an alarm signal specific to each of a plurality of degrees is emitted. It is therefore possible to detect an unacceptable use of playing media originating from a different gaming hall, and to detect a theft of playing media from a gaming machine by an employee. It is also possible to identify the gaming machine at which a fraudulent act took place. Furthermore, an alarm signal specific to the degree of variance of a payout factor is emitted, thereby facilitating a reliable detection of any over-pay and permitting easier management.

In this specification, the term "premium" means gifts, or products exchangeable for playing media of the gaming hall as well as money and other materials of value.

BRIEF DESCRIPTION OF THE DRAWINGS

The above and other objects and advantages of the present invention will become apparent from the following detailed description of the preferred embodiments when read in conjunction with the accompanying drawings, in which:

FIG. 3 shows an example of a monitor screen displaying the operation state and over-pay state of each gaming machine;

FIG. 4 shows an example of a monitor screen displaying exchange information and individual operation states;

DETAILED DESCRIPTION OF THE PREFERRED EMBODIMENTS

The following embodiments relate to a management method for gaming halls having slot machines, pachinko machines, and other gaming machines. Although each machine has a different playing medium, the management is the same. Therefore, in the following, a management method for slot machines will be described as a typical example. It is obvious that the present invention is applicable to the management of gaming halls having, for example, only slot machines.

Figure 1:
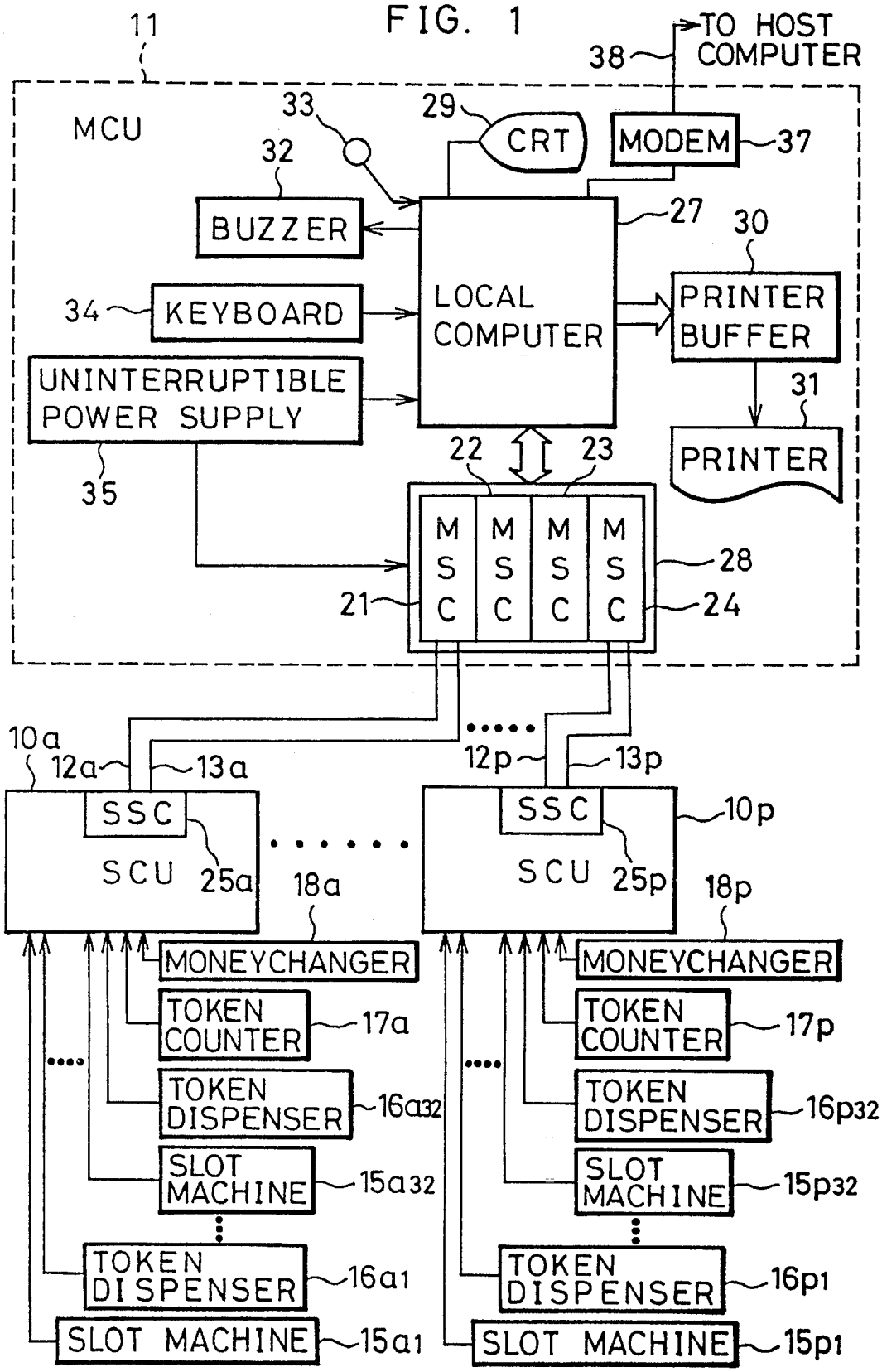
FIG. 1 is a block diagram showing the structure for performing a management method according to an embodiment of the present invention.

Referring to FIG. 1, a plurality of, for example, sixteen system control units (hereinafter abbreviated as SCU) 10*a*, 10*b*, . . . , 10*p* are connected to a main control unit (hereinafter abbreviated as MCU) serving as a management computer via connection lines such as two optical fiber cables 12 and 13. In a gaming hall, one token dispenser is mounted at the side of each slot machine. Pairs of one token dispenser and one slot machine are aligned to constitute one block. The token dispenser is adapted to receive particular paper money and coins exclusively, and to pay a predetermined number of tokens corresponding to the amount of received paper money or coins. MCU 11 is installed in an office or an exchange department of the gaming hall.

Each SCU 10*a* to 10*p* is connected to plural pairs of, for example, thirty-three pairs of a slot machine and a token dispenser. For example, SCU 10*a* is connected to a pair of a slot machine 15*a*1 and a token dispenser 16*a*1, a pair of a slot machine 15*a*2 and a token dispenser 16*a*2, . . . , a pair of a slot machine 15*a*32 and a token dispenser 16*a*32. SCU 10*a* is also connected to a token counter 17*a* and a money exchanger 18*a*.

The token counter counts tokens to be exchanged for goods or money, and issues a receipt on which the count of the tokens is printed. The money exchanger exchanges between paper money and coins, and also operates to give tokens corresponding to an amount of money designated by depressing denomination buttons on the exchanger and to give back the change. MCU 11 is provided with four photoelectric converters (hereinafter designated by MSC) 21, 22, 23, and 24 which are connected to photoelectric converters (hereinafter designated by SSC) 25*a*, 25*b*, . . . , 25*p* of SCUs 10*a*, 10*b*, . . . , 10*p* via the optical fiber cables 12 and 13.

Instead of providing one token counter and one money exchanger for each block, one or more token counters and one or more money exchangers may be provided only at the exchange department. In this case, no receipt may be necessary to be issued, because a player and an employee can check the count of tokens on a display screen.

MCU 11 has a local computer (e.g. a 32-bit personal computer) 27, and an MPU board (microprocessor unit board) 28, a CRT 29, and a printer 31 with a printer buffer 30, respectively connected to the local computer 27. The MPU board 28 has MSCs 21 to 24. The local computer 27 has a buzzer 32, a key 33 for allowing only a manager of the hall to turn on and off the local computer 27 and check information inaccessible to other employees, such as the sales amount, and a keyboard 34 for calling up, searching for, or printing out alarm data. Each slot machine is controlled to halt its operation, when the difference between the number of dividend tokens paid out for winning games and the number of tokens inserted for games, exceeds a predetermined value. This operation halt is signaled by the buzzer 32. The local computer 27 and MPU board 28 are powered from an uninterruptible power source 35 having a backup battery. The local computer 27 is connected to a host computer at the main headquarters via a modem 37 and a telephone line 38 so that the headquarters can check the operation status at each of a plurality of gaming halls.

Each SCU 10*a*, 10*b*, . . . , 10*p* converts signals from the slot machine, token dispenser, token counter, and money exchanger into optical data at SSC, and processes and transmits them to MCU 11. Each SCU also executes a minimum control of continuing the operation of each slot machine by using a built-in microcomputer even if the optical fiber cable is cut off accidentally.

The operation of the management system will now be described. When the gaming hall is opened, players move into the hall and exchange money into a predetermined number of tokens at the token dispenser of a slot machine selected by each player. If the paper money or coins the player has are not accepted by the token dispenser, the desired number of tokens can be obtained by using the money exchanger. Prior to playing a game, the player inserts, for example, one to three tokens into a slot machine inlet, and operates a start lever. When the start lever is operated, a plurality of reels of the slot machine start to rotate at the same time. In the case of an automatic-type slot machine, the reels are sequentially stopped at random timings. In the case of a manual-type slot machine, each reel is stopped by the player operating a stop button provided for each reel. When all reels stop and if a combination of symbols on a winning line is a winning symbol combination, tokens corresponding in number to the winning symbol combination are paid out.

After playing some games, if the player wishes to discontinue play, tokens on the receptacle of the slot machine are picked up by the player and inserted into the token counter which in turn issues a receipt on which the counted number of tokens is printed. This receipt is presented to a premium exchange department to receive goods or money corresponding to the count of tokens.

The amount of money received by each token dispenser 16*a*1 to 16*p*32 and the number of exchanged tokens are supplied to each corresponding SCU 10*a* to 10*p* associated with the token dispensers. The number of tokens entered into each slot machine 15*a*1 to 15*p*32 and the number of paid-out dividend tokens are supplied to each corresponding SCU 10*a* to 10*p*. The number of tokens counted by each token counter 17*a* to 17*p* is supplied to each corresponding SCU 10*a* to 10*p*. The amounts of money and the numbers of tokens are converted by SSC 25*a* to 25*p* of SCU 10*a* to 10*p* into optical data which are sent to MCU 11. Optical data are converted back into electric signals by MSCs 21 to 24 of the MPU board 28 and inputted to the local computer 27.

Figure 2:
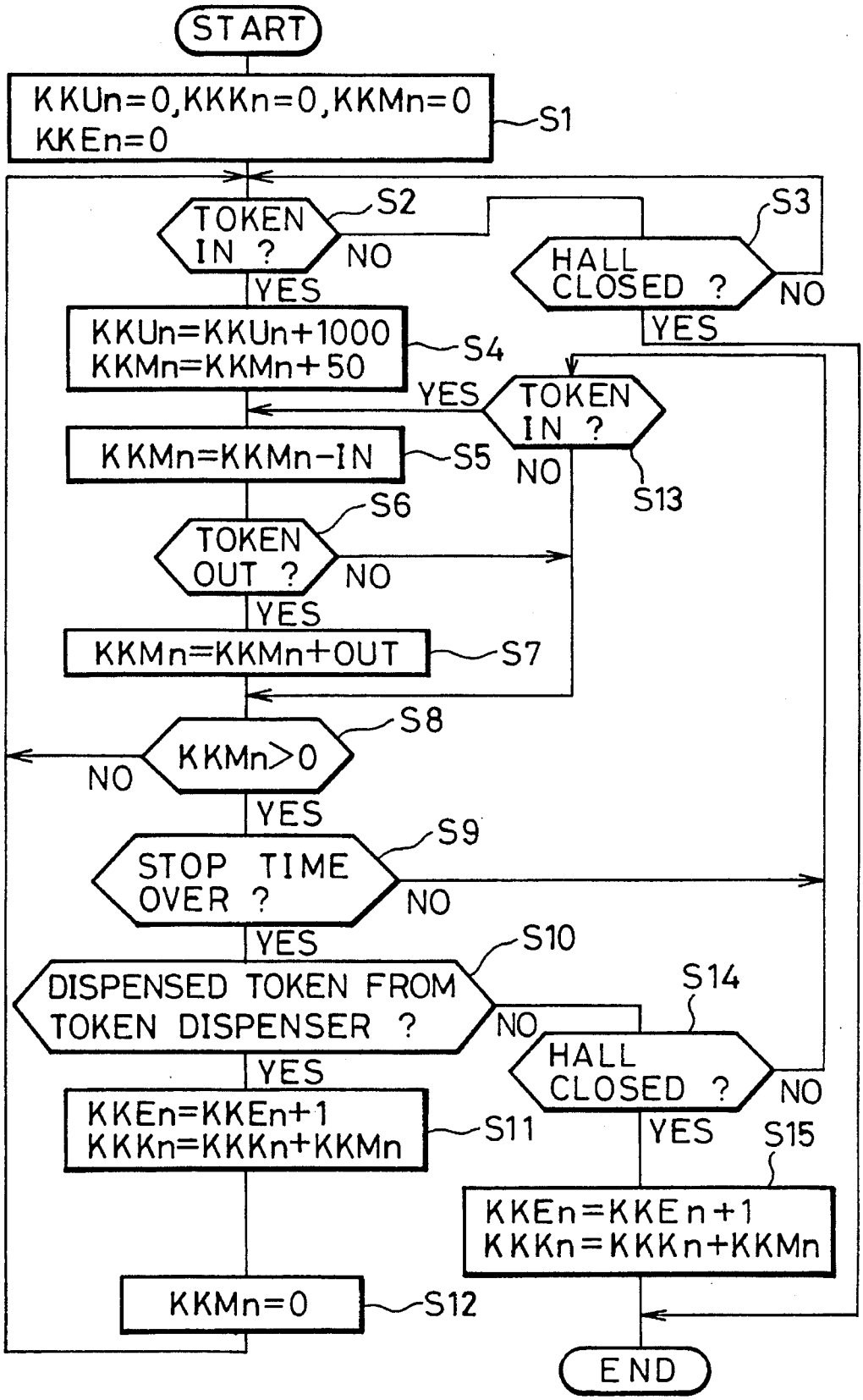
FIG. 2 is a flow chart explaining the procedure of setting each expected individual value.

The local computer 27 calculates various expected values for the management system in the manner illustrated in the flow chart of FIG. 2. These expected values are constituted of expected individual values for each slot machine and expected total values obtained through the addition of the expected individual values of all the slot machines in the gaming hall. The expected individual values are constituted of an expected individual sales amount (hereinafter represented by KKUn), an expected individual number of tokens exchanged for premiums (hereinafter represented by KKKn), an expected individual number of tokens still held by a player (hereinafter represented by KKMn), and an expected individual number of premium exchanges (hereinafter represented by KKEn). The expected total values include an expected total sales amount (hereinafter represented by KSU), an expected total number of premiums (hereinafter represented by KSK), an expected total number of tokens still held by players (hereinafter represented by KSM), an expected total number of premium exchanges (hereinafter represented by KSE), and an expected total quotient (hereinafter represented by KSW). A suffix n represents the machine number.

KKUn represents the expected sales amount for each slot machine, this amount corresponding to an expected sales amount of the token dispenser paired with each slot machine. KKKn represents the expected number of tokens exchanged for premiums by players at each slot machine. KKMn represents the expected number of tokens still held by a player. KKEn is the expected number of premium exchanges. KSW is, as will be later described, a value "10" times as much as the money amount corresponding to the sum of the expected total number of premium-exchanged tokens and the expected total number of player-held tokens, divided by the expected total sales amount. This KSW is used as a measure of management of the profit of the gaming hall.

KKUn, KKKn, KKMn, and KKEn are first obtained. The values are initialized to "0" (Step S1). It is determined whether tokens have been inserted into a slot machine (Step S2). If not, it is determined whether the gaming hall is closed (Step S3). If closed, the program is terminated, whereas if not closed, the program returns to Step S2. If tokens have been inserted into a slot machine, it is hypothesized that tokens have been dispensed by the token dispenser paired with the slot machine, and 1000 (money units) and 50 (tokens) are substituted into KKUn and KKMn, respectively (Step S4). In this case, it is assumed that the token dispenser is allowed to use only paper money having a denomination represented arbitrarily by 1000, and to pay 50 tokens per 1000 money units. The denominations of paper money and coins and the exchange rate may be determined optionally for each token dispenser. KKMn is reduced by the number of tokens entered into the slot machine (Step S5).

Next, it is determined whether any dividend token has been paid out by the slot machine (Step S6). If paid out, the number of dividend coins is added to KKMn (Step S7) and it is determined whether KKMn is larger than "0" (Step S8). If not, i.e., if it is hypothesized that the player has used all tokens, the program returns to Step S2. If larger, i.e., if it is hypothesized that the player still has tokens, the stop time (a continuous time period of nonoperation) of the slot machine is determined (Step S9). Specifically, it is first determined whether a time period T1 (e.g., two minutes) has elapsed. If elapsed, this is considered as a short halt of play caused by the player temporarily leaving the slot machine for some reason. If the lapse of a further time period T2 (e.g., two minutes) is then detected, it is determined whether money has been inserted into the token dispenser (Step S10). If money has been inserted, it is hypothesized that the player has exchanged the tokens for premiums and resumed the game, or that another player has inserted money into the token dispenser. It is also possible that the player has exchanged the tokens for premiums. Therefore, "1" is added to KKEn, and KKMn is added to KKKn (Step S11). Thereafter, KKMn is set to "0" and the program returns to Step S2.

If it is judged at Step S10 that no money has been inserted, this means a long term game halt. Therefore, it is determined whether the gaming hall is closed (Step S14). If not closed, this is considered as a long halt of game as in the case that the player has left to have a meal. In this case, the program stands by until tokens are inserted for the resumption of play (Step S13). But if the gaming hall is closed at Step S14, then the program advances to Step S15 wherein a process which is the same as in Step S11 is executed and the program is terminated.

The expected total values for the gaming hall are obtained from the following equations by substituting therein the expected individual values KKUn, KKKn, KKMn, and KKEn obtained above. The value "20" used in one equation is the exchange rate from one token to units of money.

$$KSU=KKU1+KKU2+\ldots$$

$$KSK=KKK1+KKK2+\ldots$$

$$KSM=KKM1+KKM2+\ldots$$

$$KSE=KKE1+KKE2+\ldots$$

$$KSW=10\times[20\times(KSK+KSM)/KSU]$$

Actual values obtained from data of each token dispenser and each token counter include the following values:

An actual individual sales amount (hereinafter represented by JKUn) which is the actual sales amount for each token dispenser.

An actual total sales amount (hereinafter represented by JSU) which is the actual total sales amount for all the token counters.

An actual total number of tokens exchanged for premiums (hereinafter represented by JSK) which is the total number of tokens counted by all the token counters.

A closed-hall actual total quotient which is the quotient at the time of closing the gaming hall (=10×(20× JSK)/JSU).

An actual total number of premium exchanges which is the total number of exchanges at the time of closing the gaming hall.

The actual total number of tokens exchanged for premiums at a given time while the gaming hall is open (hereinafter represented by CSK) is given by the following equation.

$$CSK=JSU/20+(AOUT-AIN)$$

where AIN represents the total number of tokens entered into all the slot machines up to a given time during the period the gaming hall is open, and AOUT represents the total number of tokens paid out up to a given time during the time the gaming hall is open.

The open-hall actual total quotient at a given time when the hall is open (hereinafter represented by CSW) is given by the following equation:

$$CSW=10\times20\times CSK/JSU$$

Two types of values JSK and CSK, and JSW and CSW are used for the actual total number of tokens exchanged for premiums and for the open-hall actual total quotient. The reason for this is as follows: If JSK is used for calculating the open-hall actual total quotient at a given time when the gaming hall is open, there will be an error because the actual number of tokens still held by the players up to that given time is not considered. Therefore, CSK and SCW are used for calculating the open-hall actual total quotient at a given time when the gaming hall is open. At the time of closing the gaming hall, all tokens still held by the players can be expected to have been exchanged for premiums, so that JSK=CSK and JSW=CSW. However, taking into consideration that there may be some players who do not exchange their tokens and that there may be some errors in each machine, JSK and JSU are used for calculating the closed-hall actual total quotient at the time of closing the hall.

This quotient is a value "10" times as much as the amount of money corresponding to the actual total number of premium-exchanged tokens divided by the actual total sales amount, before closing of the gaming hall. Thus it indicates the amount of premiums gained by players in units of 10% relative to the total sales amount of the gaming hall, so that this value can be used as a measure of the management of the profit of the gaming hall.

The expected and actual values of each slot machine (individual) and the gaming hall (overall) obtained above are compared with each other, to display an individual alarm signal (OPERATION A), an overall alarm signal (OPERATION B), exchange information, and an over-pay alarm signal (OPERATION C) on a CRT 29 or to print out hard copies of these data from a printer 31. An alarm signal emitted in accordance with a difference between the expected and actual values is called a difference alarm signal in this specification.

(1) Individual Alarm (OPERATION A)

KKUn−JKUn≦0 . . . Normal

0<KKUn−JKUn≦3000 . . . Display No. in green for machine abnormality

3000<KKUn−JKUn≦5000 . . . Display No. in yellow for machine abnormality

5000<KKUn−JKUn . . . Display No. in red for machine abnormality

If a difference between KKUn and JKUn is "0" or below, it is judged as normal. If the difference is, for example, above zero and at most 3000 money units, it is judged as a small abnormality and an alarm signal in green is emitted. If the difference is over 3000 money units and at most 5000 money units, it is judged as a medium abnormality and an alarm signal in yellow is emitted. If the difference is more than 5000 money units, it is judged as an uncommon abnormality and an alarm in red is emitted. Note that threshold values for the difference between KKUn and JKUn are empirically determined for each of the plural types of slot machines.

Differences between KKUn and JKUn are displayed on CRT 29 for example in the format shown in FIG. 3. Upon key-in from the keyboard 34, the page is scrolled to display the operation status of another block of slot machines. Calculating differences is performed for respective slot machines at different timings if Step S9 shown in FIG. 2 is affirmative, and the differences are updated. The background or numeral in each column of a machine row number shown at 40 is colored a particular color when an alarm signal is emitted. In the normal case, the background is colored white for example. The data in FIG. 3 are the data obtained after the gaming hall is closed, and an indication "CLOSED" is given in the top row of FIG. 3. OPERATION A and OPERATION B and the like displayed on CRT 29 can be printed out as they are or after they are processed to have an easy-to-recognize layout.

As shown in FIG. 4, information on the gaming hall can be displayed on CRT 29. The worst ten machines with many red alarms as well as information on the gaming hall can be also displayed.

(2) Overall Alarm (OPERATION B)

Figure 5:
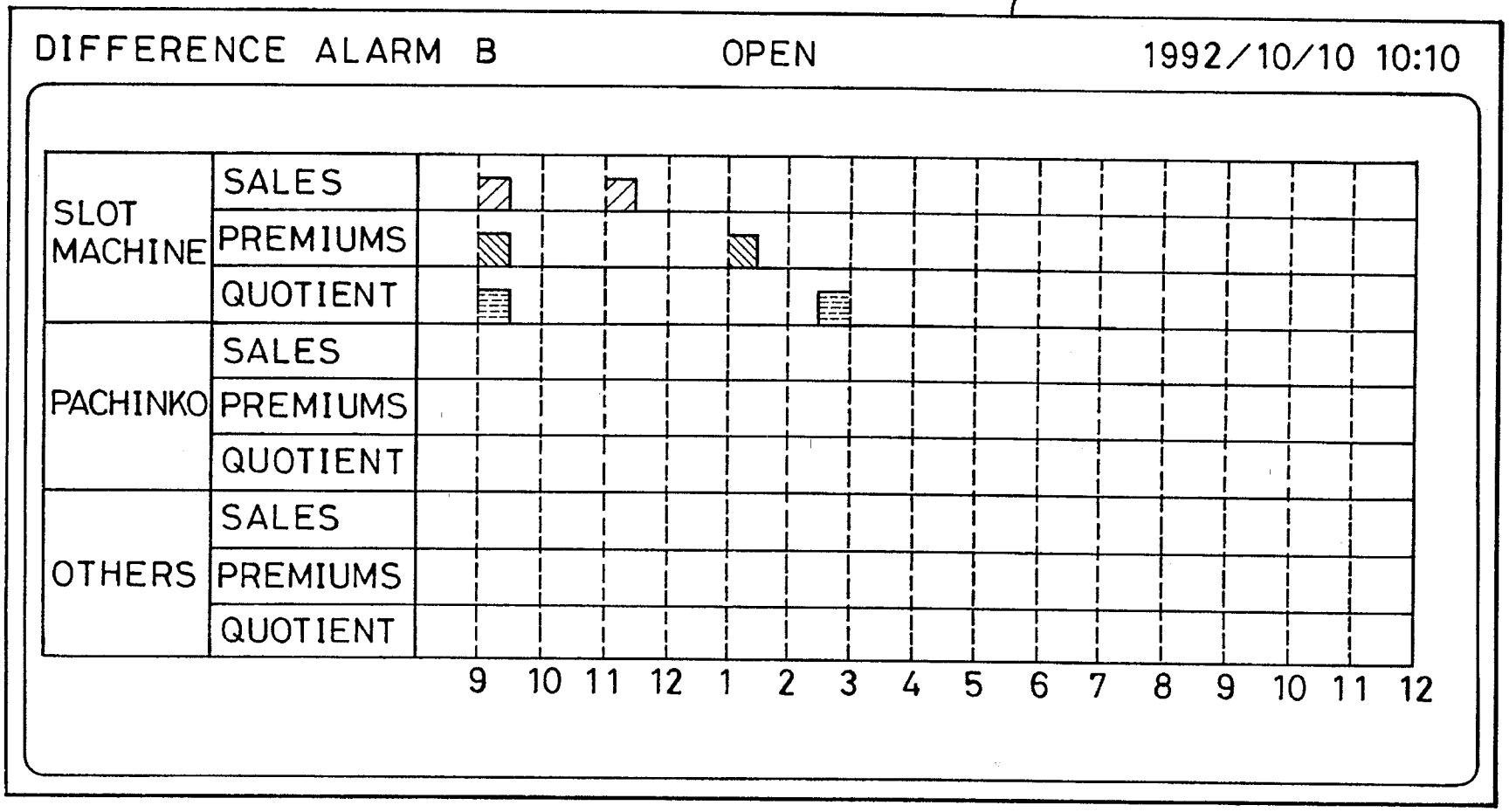
FIG. 5 shows an example of a monitor screen displaying sales, premiums, and quotients for each type of gaming machine, relative to time.

As shown in FIG. 5, the comparative results of the expected and actual values of the total sales amount, the number of tokens exchanged for premiums, and the quotient are displayed on CRT 29 at a predetermined time interval, for example, every 30 minutes. In FIG. 5, "PREMIUMS" means the number of tokens exchanged for premiums. After the hall closing time, this list is printed out.

<Sales Alarm>

KSU–JSU≦0 . . . Normal

0<KSU–JSU≦100,000 . . . Display abnormality in green 100,000<KSU–JSU≦200,000 . . . Display abnormality in yellow 200,000<KSU–JSU . . . Display abnormality in red If the difference between KSU and JSU is "0" or below, it is judged as normal. If the difference is, for example, above zero and at most 100,000 money units, depending on the size of the gaming hall, it is judged as a small abnormality and an alarm signal in green is emitted. If the difference is more than 100,000 money units and at most 200,000 money units, it is judged as medium abnormality and an alarm signal in yellow is emitted. If the difference is more than 200,000 money units, it is judged as an uncommon abnormality and an alarm signal in red is emitted.

<Premium Exchange Alarm>

KSK–JSK≦0 . . . Normal

0<KSK–JSK≦5,000 . . . Display abnormality in green 5,000<KSK–JSK≦10,000 . . . Display abnormality in yellow 10,000<KSK–JSK . . . Display abnormality in red If the difference between KSK and JSK is "0" or below, it is judged as normal. If the difference is, for example, above zero and at most 5,000 pieces, it is judged as a small abnormality and an alarm signal in green is emitted. If the difference is more than 5,000 pieces and at most 10,000, it is judged as a medium abnormality and an alarm signal in yellow is emitted. If the difference is more than 10,000 pieces, it is judged as an uncommon abnormality and an alarm signal in red is emitted.

<Quotient Alarm>

KSW–CSW≦0 . . . Normal

0<KSW–CSW≦1.0 . . . Display abnormality in green 1.0<KSW–CSW≦2.0 . . . Display abnormality in yellow 2.0<KSW–CSW . . . Display abnormality in red If the difference between KSW and CSW is "0" or below, it is judged as normal. If the difference is, for example, above zero and at most "1.0", it is judged as a small abnormality and an alarm signal in green is emitted. If the difference is more than "1.0" and at most "2.0", it is judged as a medium abnormality and an alarm signal in yellow is emitted. If the difference is more than "2.0", it is judged as an uncommon abnormality and an alarm signal in red is emitted. The hatching in FIG. 5 corresponds to the respective alarm colors. Threshold values for the difference between KSW and CSW are determined for each of the plural types of slot machines.

If the exchange information shown in FIG. 4 and printed out after the gaming hall closing time indicates too great differences, it means that the time periods T1 and T2 set at Step S9 in FIG. 2 are improper. Therefore, these time periods T1 and T2 are changed, in order to improve the alarm reliability. The exchange information shown in FIG. 4 is obtained in the manner shown in Table 1, below.

TABLE 1

| | Expected Values | Actual Values | Differences |
|---|---|---|---|
| Number of Exchanges | KSE | JSE | KSE–JSE |
| Number of Exchanged Tokens | KSK | JSK | KSK–JSK |
| Average of Exchanged Tokens | KSK/KSE | JSK/JSE | KSK/KSE–JSK/JSE |

(Over-pay Alarm) (OPERATION C)

An over-pay alarm is set so as to prevent a payout factor from becoming too high as compared to a preset value because of a failure of a machine or a fraudulent act, thereby to protect the profit of the gaming hall. The ratio between the number (IN) of tokens inserted into the slot machines and the number of paid-out dividend tokens (OUT) is calculated each time IN reaches 1000 pieces. The calculated over-pay condition of each slot machine is displayed and monitored on CRT 29, providing alarm representations in three colors, green, yellow, and red. The meanings of three colors are, for example, as follows:

100×OUT/IN<300(%) . . . Normal

300(%)≦100×OUT/IN<400(%) . . . Display abnormality in green

400(%)≦100×OUT/IN<500(%) . . . Display abnormality in yellow 500 (%)≦100×OUT/IN . . . Display abnormality in red If the ratio between the number (IN) of inserted tokens and the number (OUT) of dividend tokens is below 300%, it is judged as normal. If the ratio is at least 300% and below 400%, it is judged as a small abnormality and an alarm signal in green is emitted. If the ratio is at least 400% and below 500%, it is judged a middle abnormality and an alarm signal in yellow is emitted. If the ratio is 500% or over, it is judged as an uncommon abnormality and an alarm in red is issued. A threshold value for the ratio between the expected and actual values of each alarm is determined properly for each of the plural types of slot machines.

Figure 6:
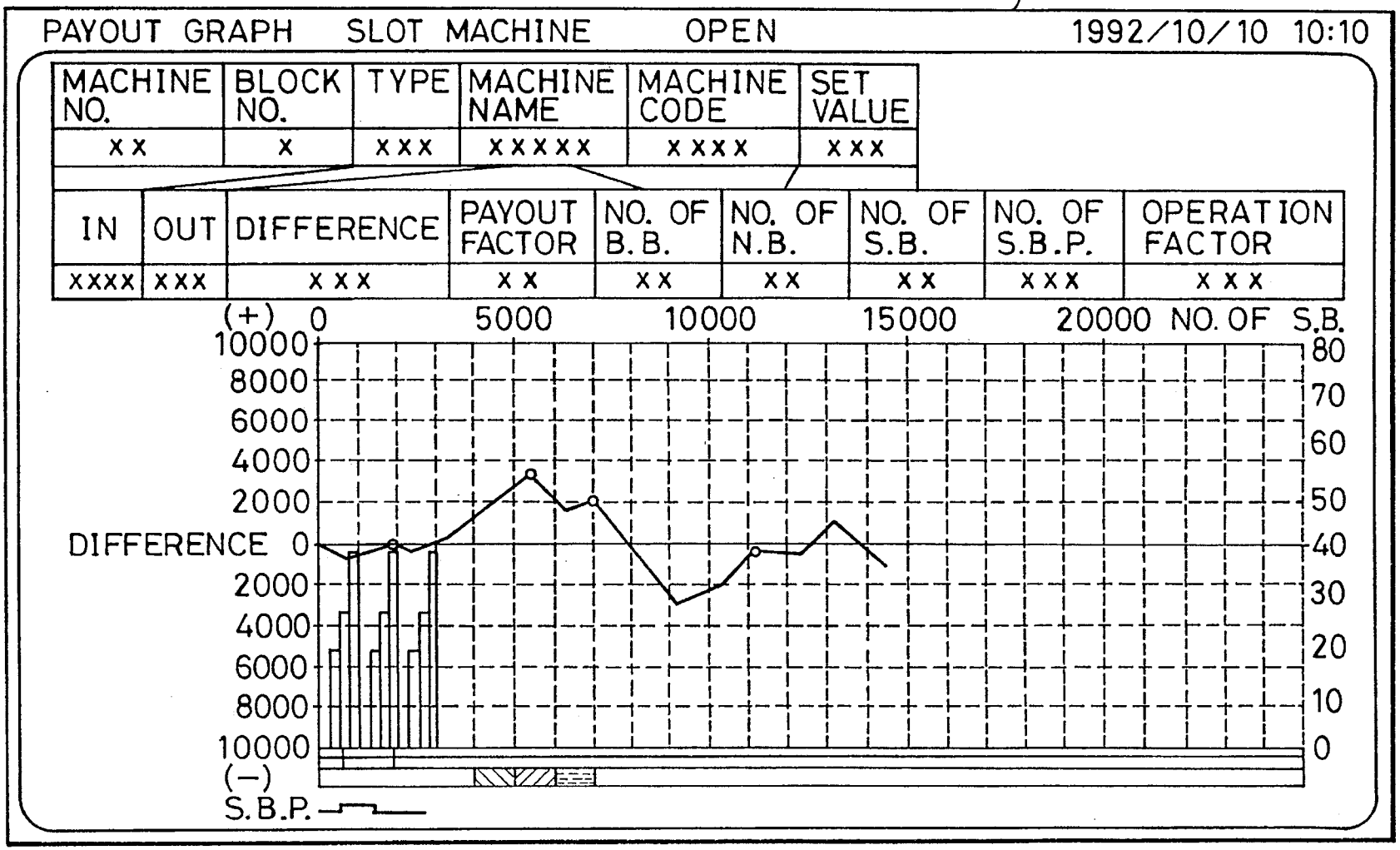
FIG. 6 shows an example of a monitor screen displaying an over-pay condition.

The abscissa of FIG. 6 represents the number (IN) of inserted tokens, and a graphical line indicates the differences between the numbers IN and OUT. "B.B." represents a big bonus giving a large number of dividend tokens, "N.B." represents a normal bonus giving a medium number of dividend tokens, "S.B." represents a small bonus giving a small number of dividend tokens, and "S.B.P." represents a single bonus party giving chances of a small bonus awarded frequently over a short period of time. Each bar represents the number of small bonus occurrences.

As described above, the degree of each alarm signal is distinguished by its color. Therefore, the gaming hall management can easily know the degree of each alarm signal during the operation of the gaming machines. Each threshold value for an alarm signal (for OPERATIONS A, B, AND C) can be set as desired for each of the plural types of gaming machines, thus refining the alarm signal management.

The following alarm messages are also displayed or printed out during the time the gaming hall is open or after the closing time of the gaming hall:

(1) When an individual sales alarm signal (number of tokens exchanged for premiums, the number of tokens still held by the player, or the number of premium exchanges) is emitted, the message reads:

"Sales amount of slot machine No. N is abnormal today. Check operations of computer signals and gaming machines."

(2) When an actual individual sales amount for a token dispenser is less than a preset value, the message reads: "Sales amount of token dispenser No. N is too small today. Check operations of computer signals and gaming machines."

Other alarm messages for an overall alarm and an overpay alarm, are also displayed and printed out. Such alarm messages in addition to alarm graphs and lists, facilitate management of the gaming halls.

In the above embodiments, slot machines have been used as examples of gaming machines. The management method of this invention is also applicable to other gambling machines such as pachinko machines and other ball machines. In the case of pachinko machines, the number (IN) of used balls and the number (OUT) of dividend balls can be calculated by associated switches or sensors for detecting launched and returned balls. The number (IN) of used balls is obtained by subtracting the number of returned "foul" balls from the number of launched balls. The number of dividend balls is the number of dividend balls paid out at a win. In the above embodiments, the difference between the expected and actual values, for example, between an expected sales amount and an actual sales amount, is calculated and displayed. Instead of a difference, a ratio between expected and actual values may be used. In other words, a comparison result (difference, ratio, or the like) between expected and actual values is calculated and displayed.

Although the present invention has been described with reference to preferred embodiments shown in the drawings, the invention should not be limited by these embodiments but, on the contrary, various modifications, changes, combinations and the like of the present invention can be effected without departing from the spirit and scope of the appended claims.

What is claimed is:

1. Apparatus for detecting fraud in and managing playing conditions of games, the games being played in a gaming hall by using playing media, the gaming hall comprising a plurality of gaming machines for paying out said playing media as dividends when a win occurs, a plurality of playing media dispensers for dispensing said playing media corresponding in number to the amount of inserted money, and at least one playing media counter for counting the number of said playing media to be exchanged for a premium, said detecting and managing apparatus comprising:

a local computer means, said local computer means comprising means for calculating an expected sales amount for each said gaming machine in accordance with data representing a number of said playing media used by said gaming machines and data representing a number of said dividend playing media, said data being supplied from each of said gaming machines, means for calculating an actual sales amount in accordance with data representing one of said inserted money amount and said number of playing media dispensed by said playing media dispenser, and means for comparing said expected sales amount with said actual sales amount; and means for displaying an alarm signal specific to a result of said comparison.

2. Apparatus for detecting fraud in and managing a gaming hall according to claim 1, wherein said means for displaying said alarm signal is a monitor display.

3. Apparatus for detecting fraud in and managing a gaming hall according to claim 1, wherein each of said gaming machines is one of a slot machine and a Japanese pin ball machine.

4. Apparatus for detecting fraud in and managing a gaming hall according to claim 3, wherein said playing media is a token for said slot machines, and is a steel ball for said Japanese pin ball machines.

5. Apparatus for detecting fraud in and managing a gaming hall according to claim 1, wherein said local computer means further comprises:

means for calculating an expected overall sales amount by adding up said expected sales amounts of all of said gaming machines each time a predetermined time period elapses;

means for calculating an overall sales amount by adding up said actual sales amounts of all of said playing media dispensers;

means for comparing said expected overall sales amount with said actual overall sales amount; and means for displaying an alarm signal specific to a result of said comparison.

6. Apparatus for detecting fraud in and managing a gaming hall according to claim 1, wherein said local computer means further comprises:

means for calculating an actual overall number of playing media exchanged for premiums, by adding up said data representing the number of playing media of said at least one playing media counter each time a predetermined time period elapses;

means for calculating an expected overall number of playing media exchanged for premiums, by adding up the numbers of playing media expected to have been exchanged for premiums;

means for comparing said expected overall number of premium-exchanged media with said actual overall number of premium-exchanged media; and means for displaying an alarm signal specific to a result of said comparison.

7. Apparatus for detecting fraud in and managing a gaming hall according to claim 1, wherein said local computer means further comprises:

means for calculating an expected overall quotient of all of said gaming machines each time a predetermined period of time elapses, in accordance with said expected overall number of premium-exchanged media and said expected overall sales amount and an expected overall number of playing media expected to be still held by players of said gaming machines;

means for calculating an actual overall quotient of all of said gaming machines each time said predetermined time period elapses, in accordance with said actual overall sales amount and the overall number of said used playing media inserted into all of said gaming machines and the overall number of said dividend playing media paid out of all of said gaming machines;

means for comparing said expected overall quotient with said actual overall quotient; and means for displaying an alarm signal specific to a result of said comparison.

8. Apparatus for detecting fraud in and managing a gaming hall according to claim 1, wherein a modulating/demodulating means is connected to said local computer means and also connected to a host computer means located in a remote location to allow operators of said host computer means at said remote location to remotely check an operational status of at least one gaming hall.

9. Apparatus for detecting fraud in and managing a gaming hall according to claim 1, wherein said detecting and managing means further comprises an uninterruptable power supply means connected to said local computer means to supply power to said local computer means in the event of a power failure.

10. Apparatus for detecting fraud in and managing a gaming hall according to claim 1, wherein each of said plurality of gaming machines comprises operation ceasing means for ceasing operation of said gaming machines when a difference between a number of dividend media paid out for winning games and a number of media inserted for games exceeds a predetermined value, said operation ceasing means being controlled by signals generated by said local computer means.

11. Apparatus for detecting fraud in and managing a gaming hall according to claim 1, further comprising:

at least one systems control unit (SCU) comprising means for collecting electrical data from at least one of said gaming machines, from at least one of said plurality of playing media dispensers, and from said at least one playing media counter, said SCU also comprising means for converting said collected data into optical data, and means for transmitting said converted optical data along an optical fiber cable means; and means for receiving and converting said optical data back to electrical data, said receiving and converting means being connected to said optical fiber cable means;

wherein said local computer means is connected to said receiving and converting means.

12. Apparatus for detecting fraud in and managing a gaming hall according to claim 11, wherein each of said gaming machines is paired with a playing media dispenser to form a block, each block transmitting data to said local computer via said systems control unit, said optical fiber cable means, and said means for receiving and converting said optical data.

13. Apparatus for detecting fraud in and managing a gaming hall according to claim 11, wherein said systems control unit also comprises a built-in microcomputer to control said gaming machines connected thereto if said optical fiber cable means is accidentally interrupted.

14. Apparatus for detecting fraud in and managing playing conditions of games, the games being played in a gaming hall by using playing media, the gaming hall comprising a plurality of gaming machines for paying out said playing media as dividends when a win occurs, a plurality of playing media dispensers for dispensing said playing media corresponding in number to the amount of inserted money, and at least one playing media counter for counting the number of said playing media to be exchanged for a premium, said detecting and managing apparatus comprising:

means for retrieving, across a fiber optic cable means, data corresponding to a number of playing media inserted into each of said plurality of gaming machines;

means for retrieving, across said fiber optic cable means, data corresponding to a number of playing media paid out as dividends;

means for comparing said retrieved number of used playing media with said retrieved number of playing media paid out as dividends, said comparison means performing a comparison for each of said plurality of gaming machines; and means for displaying an alarm signal specific to a result generated by said comparison means for each of said plurality of gaming machines.

15. Apparatus for detecting fraud and managing playing conditions of games according to claim 14, wherein said comparison means comprises means for calculating a difference between said numbers.

16. Apparatus for detecting fraud and managing playing conditions of games according to claim 15, wherein said comparison means further comprises means for calculating said difference each time said number of used playing media is incremented by a predetermined number.

17. Apparatus for detecting fraud and managing playing conditions of games according to claim 14, wherein said alarm signal displaying means is a monitor display.

18. Apparatus for detecting fraud and managing playing conditions of games according to claim 17, wherein said monitor display comprises means for displaying said difference as a polygonal line graph.

19. Apparatus for detecting fraud and managing playing conditions of games according to claim 18, wherein said monitor display comprises means for displaying colored bars corresponding to a degree of said comparison on said polygonal line graph along the abscissa, to thereby provide an alarm display.

20. Method for detecting fraud in and managing playing conditions of games, the games being played in a gaming hall by using playing media, the gaming hall comprising a plurality of gaming machines for paying out said playing media as dividends when a win occurs, a plurality of playing media dispensers for dispensing said playing media corresponding in number to the amount of inserted money, and at least one playing media counter for counting the number of said playing media to be exchanged for a premium, said method comprising the steps of:

collecting data in electrical form in at least one systems control unit (SCU) from at least one of said gaming machines, from at least one of said plurality of playing media dispensers, and from said at least one playing media counter;

calculating, using a local computer means, an expected sales amount for each said gaming machine in accordance with data representing a number of said playing media used by said gaming machines and data representing a number of said dividend playing media, said data being supplied from each of said gaming machines;

calculating an actual sales amount in accordance with data representing one of said inserted money amount and said number of playing media dispensed by said playing media dispenser;

comparing said expected sales amount with said actual sales amount; and displaying an alarm signal specific to a result generated by said comparison step.

21. Method according to claim 20, further comprising the step of:

displaying an identification number of each of said plurality of gaming machines, said expected sales amount and said actual sales amount and said result of said comparison step respectively correspond to said identification number.

22. Method according to claim 21, further comprising the step of:

coloring, in said display step, said identification number in accordance with a degree of said comparison result.

23. Method according to claim 22, further comprising the step of:

grouping each of said plurality of gaming machines with one of said plurality of said playing media dispensers into a plurality of blocks, each block transmitting said data via a system controller to said management control means.

24. Method according to claim 20, further comprising the steps of:

calculating an expected overall sales amount by adding up said expected sales amounts of all of said plurality of gaming machines each time a predetermined time period elapses;

calculating an actual overall sales amount by adding up said actual sales amounts of all of said playing media dispensers;

comparing said expected overall sales amount with said actual overall sales amount; and displaying an alarm signal specific to a result of said comparison step.

25. Method according to claim 20, further comprising the steps of:

calculating an actual overall number of playing media exchanged for premiums, by adding up said data representing the number of playing media of said at least one playing media counter each time a predetermined time period elapses;

calculating an expected overall number of playing media exchanged for premiums, by adding up the numbers of playing media expected to have been exchanged for premiums;

comparing said expected overall number of premium-exchanged media with said actual overall number of premium-exchanged media; and displaying an alarm signal specific to a result of said comparison step.

26. Method according to claim 20, further comprising the steps of:

calculating an expected overall quotient for all of said plurality of gaming machines each time a predetermined time period elapses, in accordance with said expected overall number of premium-exchanged media and said expected overall sales amount and an expected overall number of playing media expected to be still held by players;

calculating an actual overall quotient for all of said plurality of gaming machines each time said predetermined time period elapses, in accordance with said actual overall sales amount and the overall number of said used playing media inserted into all of said plurality of gaming machines and the overall number of said dividend playing media paid out of all of said plurality of gaming machines;

comparing said expected overall quotient with said actual overall quotient; and displaying an alarm signal specific to a result of said comparison step.

27. Method according to claim 20, further comprising the step of:

remotely checking an operational status of said gaming hall using modulating/demodulating means connected to said local computer means and also connected to a host computer means located in a remote location.

28. Method according to claim 20, further comprising the step of:

supplying, in the event of a power failure, power to said local computer using an uninterruptable power supply means connected to said local computer.

29. Method according to claim 20, further comprising the step of:

halting an operation of a gaming machine when a difference between a number of dividend media paid out for winning games and a number of media inserted for games exceeds a predetermined value, said halting step being carried out by gaming machine halting means controlled by signals generated by said local computer means.

30. Method for detecting fraud in and managing playing conditions of games according to claim 20, further comprising the steps of:

converting, in converting means disposed in said SCU, said collective electric data into optical data;

transmitting said converted optical data along an optical fiber cable means using transmitting means disposed in said SCU;

receiving and converting said optical data back to electrical data using receiving and converting means, said receiving and converting means being connected to said optical fiber cable means.

31. Method for detecting fraud in and managing playing conditions of games, the games being played in a gaming hall by using playing media, the gaming hall comprising a plurality of gaming machines for paying out said playing media as dividends when a win occurs, a plurality of playing media dispensers for dispensing said playing media corresponding in number to the amount of inserted money, and at least one playing media counter for counting the number of said playing media to be exchanged for a premium, said method comprising the steps of:

retrieving, across a fiber optic cable means, data corresponding to a number of playing media inserted into each of said plurality of gaming machines;

retrieving, across said fiber optic cable means, data corresponding to a number of playing media paid out as dividends;

comparing said data corresponding to said retrieved number of used playing media with said data corresponding to said retrieved number of playing media paid out as dividends, said comparison step being performed for each of said plurality of gaming machines; and displaying an alarm signal specific to a result generated by said comparison step for each of said plurality of gaming machines.

32. Method according to claim 31, further comprising the step of:

calculating a difference between said data corresponding to said number of playing media inserted into each of said plurality of gaming machines and said data corresponding to said number of playing media paid out as dividends.

33. Method according to claim 32, further comprising the step of:

repeating said step comparing said data corresponding to said number of playing media inserted into each of said plurality of gaming machines with said data corresponding to said number of playing media paid out as dividends each time said number of used playing media is incremented by a predetermined number.

34. Method according to claim 32, further comprising the step of:

displaying said difference as a polygonal line graph.

35. Method according to claim 34, further comprising the step of:

displaying colored bars corresponding to a degree of said comparison on said polygonal line graph along an abscissa of said graph, to thereby provide an alarm display.

* * * * *